United States Patent [19]

Ward

[11] 4,041,662

[45] Aug. 16, 1977

[54] STAIRCASES

[75] Inventor: Donald Leslie Ward, Leigh-on-Sea, England

[73] Assignee: Wards Construction (Overseas) Ltd., Irish Town, Gibraltar

[21] Appl. No.: 579,275

[22] Filed: May 20, 1975

[30] Foreign Application Priority Data

May 22, 1974 United Kingdom ..... 22975/74
Nov. 18, 1974 United Kingdom ..... 49895/74

[51] Int. Cl.[2] ..... E04F 11/00; E04F 11/12

[52] U.S. Cl. ..... 52/187; 52/188; 52/182

[58] Field of Search ..... 52/184–197, 52/182

[56] References Cited

U.S. PATENT DOCUMENTS

| | | | |
|---|---|---|---|
| 811,436 | 1/1906 | Plotkin | 52/188 |
| 1,452,467 | 4/1923 | Lambert | 52/191 |
| 1,789,969 | 1/1931 | Davis | 52/191 |
| 3,196,997 | 7/1965 | Hager | 52/182 |
| 3,473,275 | 10/1969 | Lappin | 52/187 |
| 3,556,251 | 1/1971 | Whitehead | 52/182 |

FOREIGN PATENT DOCUMENTS

| | | | |
|---|---|---|---|
| 513,187 | 9/1893 | Germany | 52/182 |
| 23,243 | 2/1901 | Germany | 52/184 |
| 801,857 | 12/1950 | Germany | 52/188 |
| 1,170,595 | 11/1969 | United Kingdom | 52/182 |
| 20,055 | 11/1900 | United Kingdom | 52/182 |
| 873,952 | 8/1961 | United Kingdom | 52/187 |
| 1,335,829 | 10/1973 | United Kingdom | 52/126 |

*Primary Examiner*—Price C. Faw, Jr.
*Assistant Examiner*—Henry Raduazo
*Attorney, Agent, or Firm*—Burgess, Ryan and Wayne

[57] ABSTRACT

A staircase construction is disclosed in which a plurality of identical riser units are bolted together in series, each riser unit comprising a tread member in the form of a flat slab, and two bracket members each supporting a respective end of the tread member.

Each bracket member is formed from metal strip bent to shape in one plane and welded as and where appropriate and has a first horizontal planar part supporting the respective tread member and a second horizontal planar part spaced above the first part by the unit riser height and supporting a rear part of the first horizontal planar part of the next higher bracket member on the same side of the staircase, the last mentioned bracket member being set forward with respect to the bracket member being set forward with respect to the bracket member which supports it.

20 Claims, 16 Drawing Figures

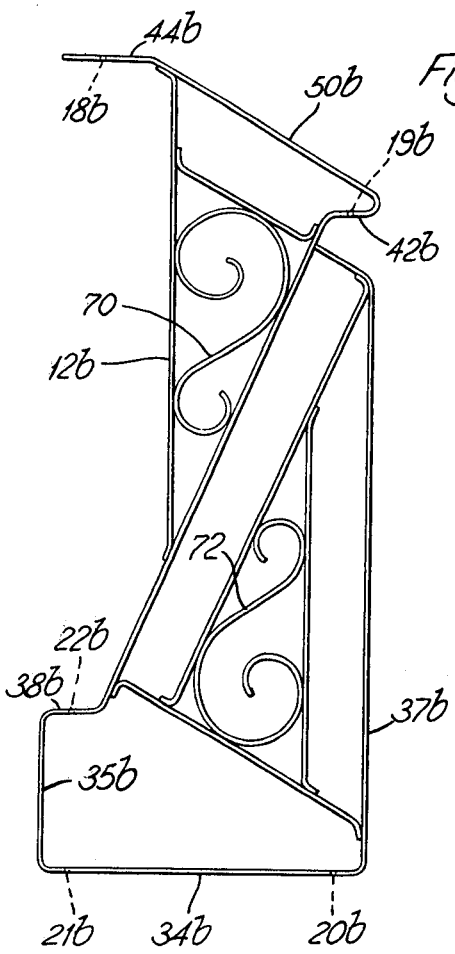
Fig. 14.
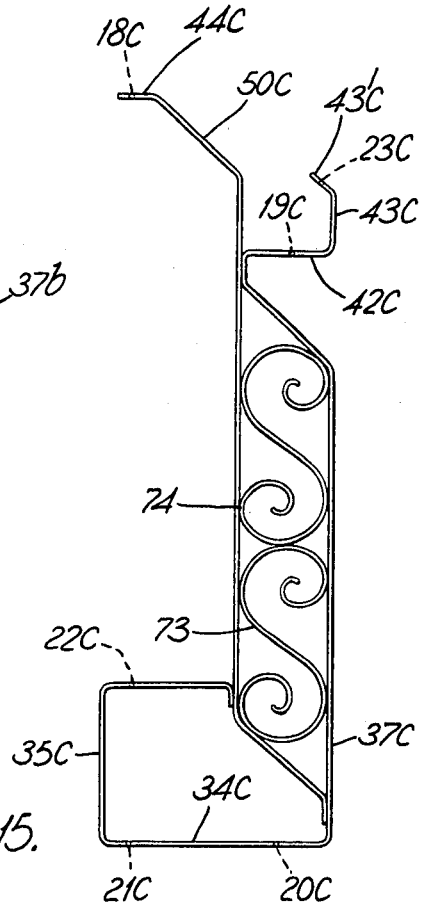
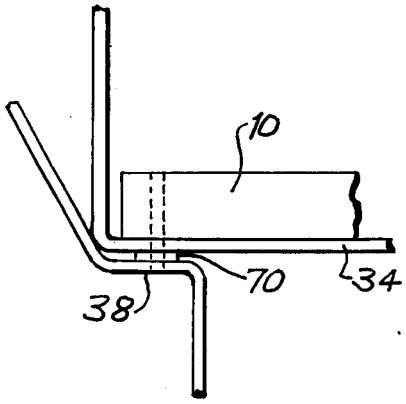
Fig. 15.
Fig. 16

STAIRCASES

The present invention relates to staircases.

BACKGROUND OF THE INVENTION

Staircase in buildings are generally somewhat expensive constructions, since a given staircase in generally designed specifically for a specific design of building, so that in most cases mass production techniques cannot be applied, and each staircase requires considerable skill and labour to construct, generally on the building site.

SUMMARY OF THE INVENTION

It is an object of one aspect of the present invention to provide a staircase which is simple and economical in construction.

According to this aspsect of the invention there is provided a staircase comprising a plurality of tread members each connected to the or each adjacent tread member by a least two associated bracket members.

The staircase may include a handrail formed by cooperating portions of said bracket members.

Alternatively, one of the bracket members associated with each tread member may be connected to a handrail formed separately from the bracket members.

Each tread member may be formed integrally with its associated members or may be formed separately therefrom and secured thereto by suitable fixing means, for example bolts.

Preferably the tread members are identical with each other and each bracket member associated with any tread member is identical with the corresponding bracket member associated with any other tread member.

Preferably each said tread member is formed separately from its associated bracket members and is secured thereto by fastening elements.

It is another object of the invention to provide a kit from which a staircase can be constructed, said kit comprising a plurality of identical riser units each comprising a tread member and at least two associated bracket members, each riser unit being adapted to be secured in a predetermined relation to an identical riser unit.

At least one bracket member of each said riser unit may have adjacent a lower end thereof attachment points for engagement with corresponding attachment points of similar bracket members, and may have adjacent an upper end thereof attachment points for engagement with corresponding attachment points of similar bracket members, and may have additionally adjacent said upper end an attachment part for securing to a handrail.

Each riser unit may be an integral unit or may comprise a plurality of parts adapted to be fitted together.

According to another aspect of the invention there is provided a bracket member for a staircase comprising a part adjacent a bottom end of the bracket member providing a planar support surface adapted to support a planar tread member, first and second fixing points adjacent said bottom end and spaced apart in a direction parallel to the plane of said planar support surface and also in a direction perpendicular to said plane, and third and fourth fixing points adjacent an upper end of the bracket member, and third fixing point being spaced from, and aligned with, said first fixing point in a direction perpendicular to said plane and said fourth fixing point being correspondingly spaced from said second fixing point in a direction perpendicular with said plane and being aligned with said second fixing point in the last mentioned direction, the bracket member being so formed that a series of identical such bracket units can be interconnected with each bracket member having a first and third fixing points fixed to the second and fourth fixing points of one adjacent bracket member and its second and fourth fixing points fixed to said first and third fixing points of the adjacent bracket members.

BRIEF DESCRIPTION OF THE DRAWINGS

In the drawings:

FIG. 14 is a side elevation view of a bracket member similar to that of FIG. 1, but incorporating ornamental scroll work which also acts as a safeguard, FIG. 15 is a side elevation view of a bracket member similar to that of FIG. 7, but incorporating ornamental scroll work which also acts as a safeguard, and FIG. 16 is an enlarged side view of a portion of the bracket assembly of FIG. 4.

DESCRIPTION OF THE PREFERRED EMBODIMENTS

Figure 1:
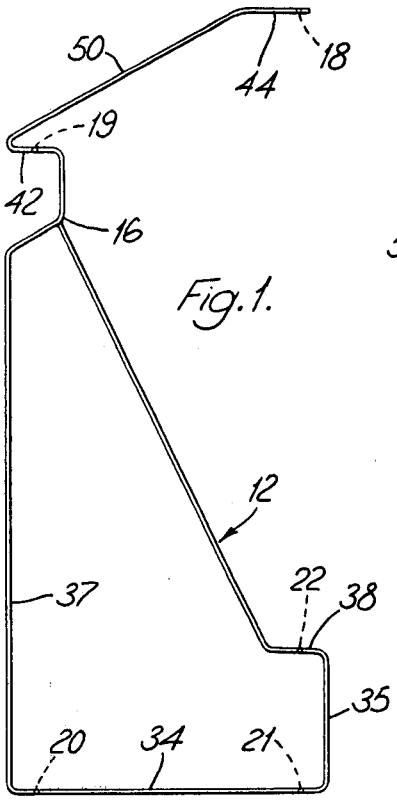
FIG. 1 is a side elevation view of a first form of bracket member used in a spiral staircase forming one embodiment of the invention.
Figure 3:
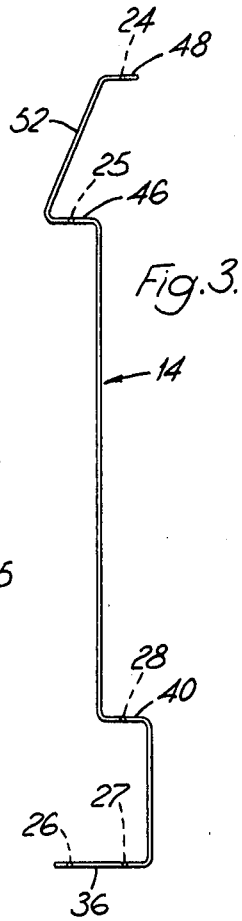
FIG. 3 is a side elevation of a second form of bracket member used in this spiral staircase.
Figure 2:
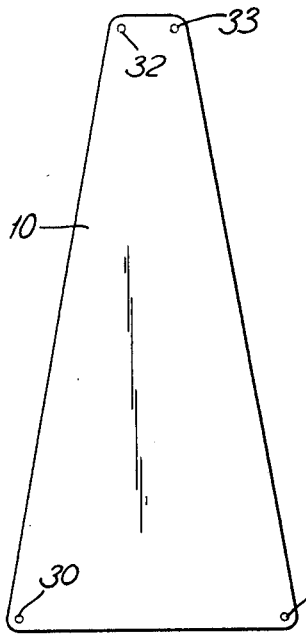
FIG. 2 is a plan view of a tread member for this spiral staircase.

Referring to the FIGS. 1 to 6, a spiral staircase is formed by a plurality of identical riser assemblies each comprising three integers, viz a planar tread member 10 in the form of a flat board or plank having in plan the trapezoidal shape shown in FIG. 2, an outer bracket member 12 shown in side elevation in FIG. 1 and an inner bracket member 14 shown in side elevation in FIG. 3. The inner and outer bracket members are each formed of a single piece of elongated flat steel strip bent to provide the forms shown, and, in the case of the member 12, welded at 16. The strip is bent in the plane of the drawings in FIGS. 1 and 3 so that each longitudinal edge of the bent strip lies entirely in a plane parallel with the plane of FIGS. 1 and 3.

The bracket member 1 has its bottom formed by a first horizontal planar part 34, which forms the base of a U-shaped formation having vertically upstanding arms provided by one side part 35 and a lower part of another side part 37. A second horizontal planar part 38 is provided at the upper end of part 38. A third horizontal planar part 42 is provided, spaced vertically above the part 34 and a fourth horizontal planar part 44, connected with the part 42 by a sloping part 50, is provided spaced vertically above the part 38 by an amount equal to the vertical spacing between the parts 34 and 42.

The bracket member 14 has first, second, third and fourth horizontal planar parts 36, 40, 46 and 48 respectively, the third and fourth planar parts being connected by a sloping part 52, and the vertical spacing between the first, second, third and fourth planar parts being the same as in the bracket 12.

Holes, indicated at 18, 19, 20, 21 and 22 are formed in the strip in the bracket 12 and holes indicated at 24, 25, 26, 27 and 28 are formed in the strip in the bracket 14.

The holes 20, 22, 19 and 18 define respectively first, second, third and fourth fixing points on the first, second, third and fourth horizontal planar parts of the bracket 12, while the holes 26, 28, 25 and 24 define respectively first, second, third and fourth fixing points on the first, second, third and fourth horizontal planar parts of the bracket 14.

The tread member 10 is formed at its corners with holes 30, 31, 32 and 33.

The holes 19 and 20 are aligned vertically in the bracket 12 and the holes 18, 21 and 22 are also aligned vertically.

In the bracket 14 the hole 24 is aligned vertically with the holes 27 and 28, while the hole 25 is aligned vertically with the hole 26.

It will thus be seen that the first, second, third and fourth fixing points in each bracket lie at the respective corners of a respective parallelogram. However, the horizontal spacing between the first and second fixing points in the bracket 12 is greater than the horizontal spacing between the first and second fixing points in the bracket 14.

The staircase is constructed as follows. The lowest riser assembly is constructed by placing the broader end of a tread member 10 on top of the bottom horizontal limb 34 of a bracket member 12 with the hole 30 registering with the hole 20 and the hole 31 registering with the hole 21, while the narrower end of the tread member is placed on top of the lower horizontal limb 36 of the bracket 14 with the hole 32 registering with the hole 26 and the hole 33 registering with the hole 27. The tread member 10 and members 12 and 14 are fixed together in this relationship by screws passed through the registering hole in the tread member and brackets.

In the case of the lowest riser assembly these screws may also pass into the floor to secure the riser assembly thereto with the tread member horizontal and closely adjacent the floor and the major parts of the brackets extending upwardly therefrom. The next riser assembly is assembled in the same way but is fitted to the lowest riser assembly in such a way that the end portion of the limb 34 of the bracket 12 of said next riser assembly having the hole 20 is placed on top of a horizontal ledge portion 38 of the lowest bracket 12, having the hole 22 and a single bolt is passed through the registering holes 30, 20 (of the upper riser assembly) and 22 (of the lower riser assembly) and thus serves to secure together the upper bracket 12 and upper tread 10 and at the same time to secure the upper riser assembly to the lower. Similarly the end portion of the lower horizontal limb of the upper bracket 14, which has the hole 26 is placed on top of the horizontal ledge portion 40 of the lower bracket 14 having the hole 28, with the holes 32 and 26 of the upper riser assembly and the hole 28 of the lower riser assembly in register and a single bolt is passed through holding the upper tread member 10 and the upper bracket 14 together and holding the upper tread assembly on the lower assembly.

Furthermore, when the two riser assemblies are so arranged the horizontal part 42 of the upper bracket 18, having the hole 19, lies on top of the upper horizontal end part 44 of the lower bracket 12, and the hole 19 of the upper bracket 12 is in register with the hole 18 of the lower bracket 12. The part 42 of the upper bracket and the end part 44 of the lower bracket are clamped together by a single bolt passed through the aligned holes 18 and 19.

Similarly the horizontal part 46 of the upper bracket 14, having the hole 25, lies on top of a horizontal upper end part 48 of the lower bracket 14, having the hole 25, with the holes 25 and 24 of the upper and lower brackets 14 in register, and a single bolt passing through the latter holes clamps the parts 46 and 48 together.

Further riser assemblies are fitted correspondingly, each being fitted to the one below in the same fashion.

Figure 5:
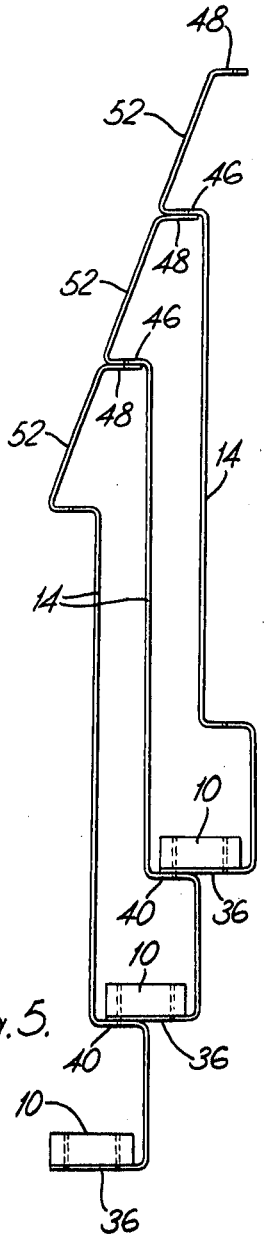
FIG. 5 is a side elevational developed view of three bracket members of the form shown in FIG. 2 interconnected with respective tread members fitted thereto.
Figure 4:
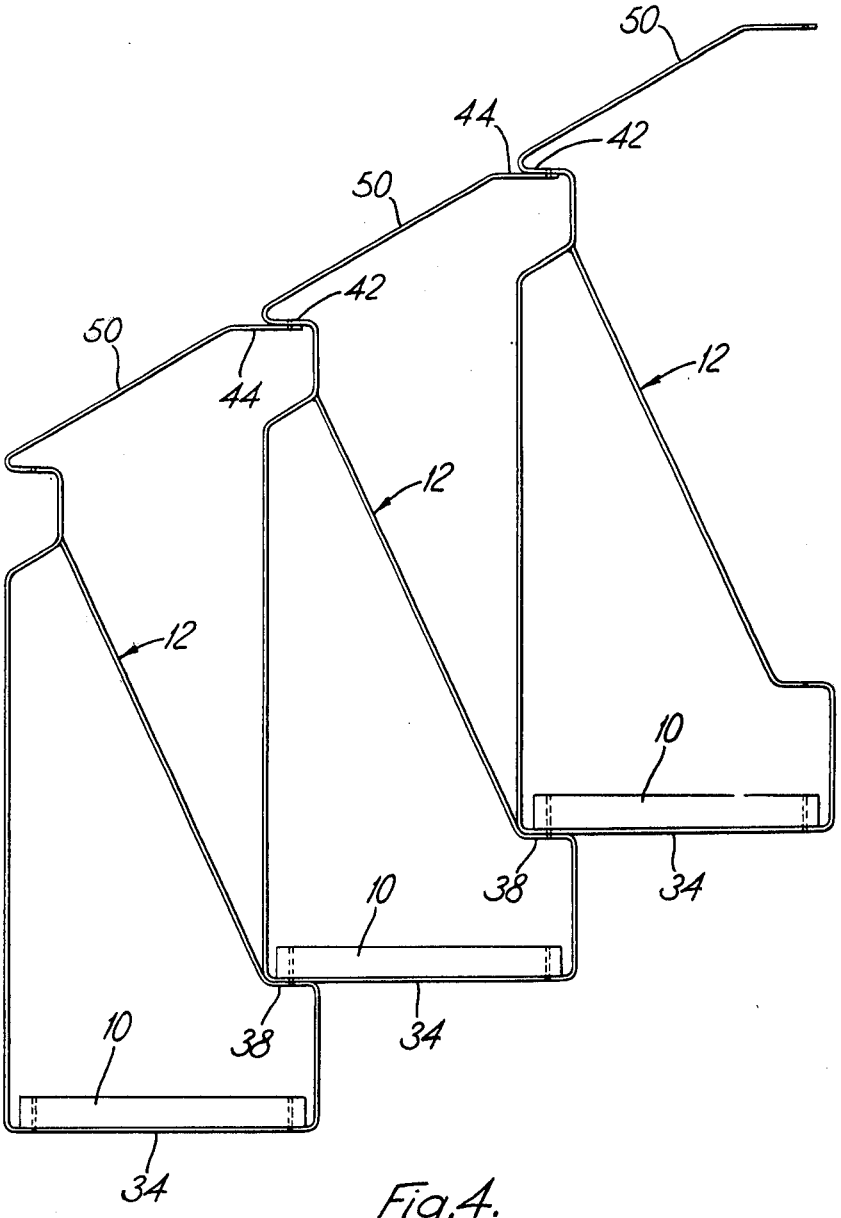
FIG. 4 is a side elevational developed view of three bracket members of the form shown in FIG. 1 interconnected with respective tread members fitted thereto.

FIG. 4 is a developed side elevation view from the radially outer side of the staircase of three riser assemblies so fitted, and FIG. 5 is a corresponding view from the radially inner side of the staircase. It will be noted that adjacent sloping parts 50 of the adjacent brackets 12 form an outer handrail and that adjacent portions 52 of adjacent brackets 14 form an inner handrail.

Figure 6:
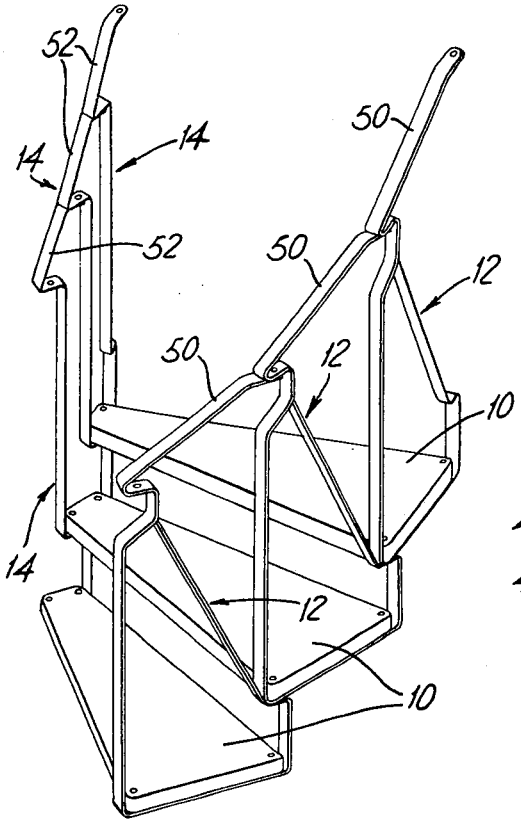
FIG. 6 is a perspective view of part of this spiral staircase.

FIG. 6, which is a perspective view of part of the spiral staircase, shows the construction clearly.

It will be appreciated that a spiral staircase of any desired height, provided it is a multiple of the basic riser height, (i.e., the vertical distance in the staircase described between the top of one tread member 10 and the top of an adjacent tread member) may be constructed by appropriately assembling the required number of identical riser units.

Where the desired staircase height is not a multiple of the basic riser height, the effective riser height of some or all riser assemblies may be increased by interposing washers or spacer elements between adjacent brackets 12 and 14 of adjacent riser assemblies, around the bolts securing these brackets together.

The angle between the treads of the spiral staircase is preferably in the region of from 20° to 24°, but by forming the various holes in the brackets as longitudinal slots, this angle may be made variable at the desire of the assembler.

It will be noted that a straight, rather than a spiral staircase can be formed from a plurality of riser units each including two brackets 12 and a rectangular tread member, so assembled that from each side the staircase is as shown in FIG. 4. Similarly a staircase comprising straight portions connected by curving portions can be constructed from combinations of riser units for straight and spiral staircases.

Figure 7:
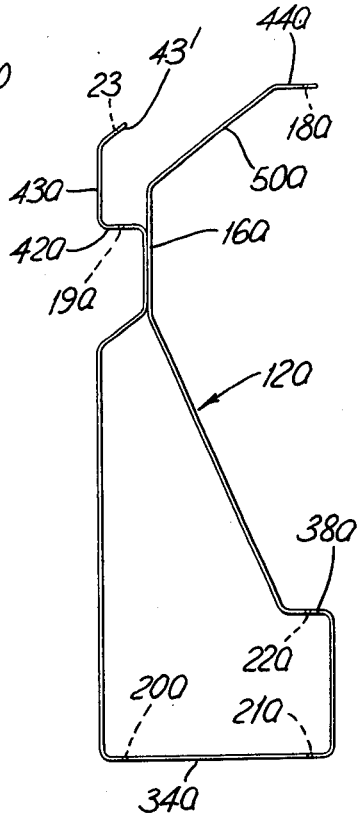
FIG. 7 is a side elevation view of a third form of bracket member used in a straight staircase forming another embodiment of the invention.
Figure 8:
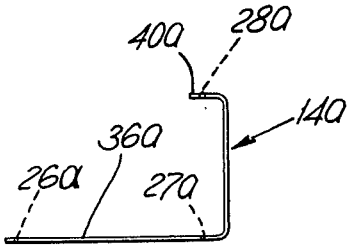
FIG. 8 is a side elevation view of a fourth form of bracket member used in said staircase.
Figure 9:
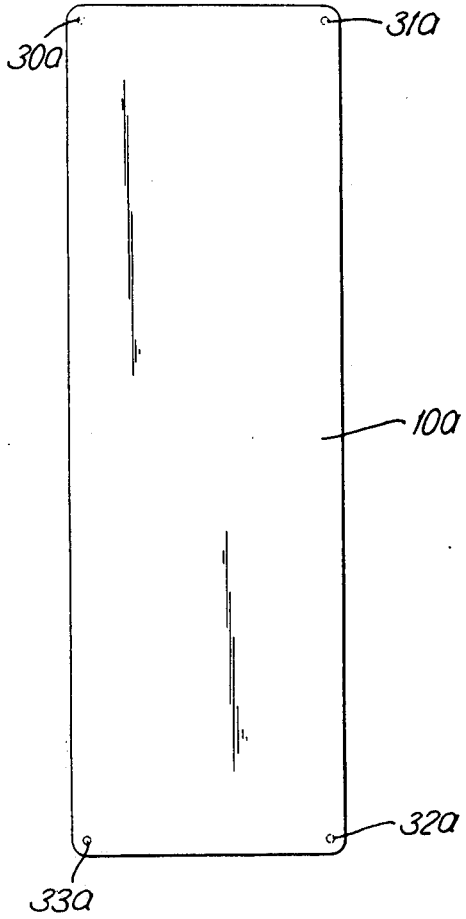
FIG. 9 is a plan view of a tread member used in this straight staircase.
Figure 12:
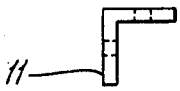
FIG. 12 is a view of bracket for fixing to a wall to support part of the staircase.
Figure 11:
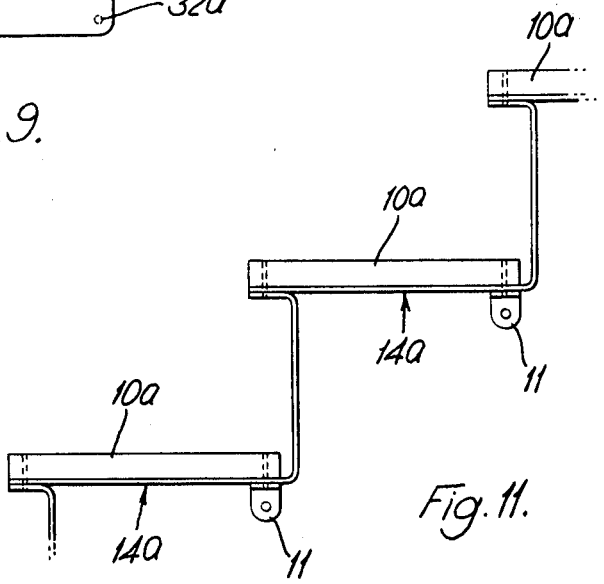
FIG. 11 is a side elevation view of part of the outer side of this straight staircase which is secured to a wall.

Referring to FIGS. 7 to 12, in which parts corresponding to parts in FIGS. 1 to 6 have the same reference numeral, with the suffix *a*, a straight staircase, running alongside a wall, is formed by a plurality of identical riser assemblies each comprising a plurality of integers, viz a planar tread member 10*a* in the form of a flat board or plank having in plan the rectangular shape shown in FIG. 9, an outer bracket member 12*a* shown in side elevation in FIG. 7, an inner bracket member 14*a* shown in side elevation in FIG. 8 and an angle bracket 11 (FIGS. 11 and 12). The inner and outer bracket members are each formed of a single piece of flat steel strip bent to provide the forms shown, and, in the case of the member 12*a*, welded at 16*a*. The strip is bent in the plane of the drawings in FIGS. 7 and 9 so that each longitudinal edge of the bent strip lies entirely in a plane parallelwith the plane of FIGS. 7 and 9.

Holes, indicated at 18*a*, 19*a*, 20*a*, 21*a*, 22*a* and 23 are formed in the strip in the bracket 12*a* and holes indicated at 26*a*, 27*a* and 28*a* are formed in the strip in the bracket 14*a*.

The tread member 10*a* is formed at its corners with holes 30*a*, 31*a*, 32*a* and 33*a*.

The holes 19*a* and 20*a* are aligned vertically in the bracket 12*a* and the holes 18*a*, 21*a* and 22*a* are also aligned vertically.

In the bracket 14*a* the hole 28*a* is aligned vertically with the hole 27*a*.

It will be noted that while the bracket 12*a* is very similar to the bracket 12, the bracket 14*a* is of short vertical extent and has only first and second fixing points but no third or fourth fixing points. It will also be noted that the horizontal spacing between the first and second fixing points on the bracket member 14*a* is the same as that between the first and second fixing points on the bracket member 12*a*.

The staircase is constructed as follows.

Figure 13:
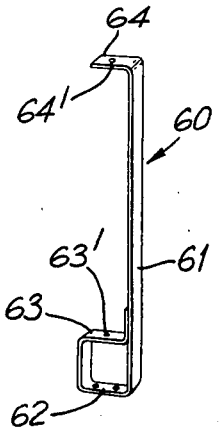
FIG. 13 is a perspective view of a pillar for use at the foot of a staircase.

A pillar, for example, of the form shown in FIG. 13 is bolted to the floor at the desired distance from the wall and an angle bracket 11 fixed to the wall. The pillar 60 shown comprises a metal strip bent to provide a vertical part 61, a base 62, a lower support part 63 and an upper support part 64. The parts 63 and 64 each extend horizontally and are provided with respective apertures 63' and 64' in vertical alignment, the vertical spacing between the support parts 63 and 64 being equal to that between the parts 44*a* and 38*a* of the bracket 12*a*. A bracket 11 is bolted to the wall in horizontal alignment with the lower support part 63.

The lowest riser assembly is then mounted on the bracket 11 and the pillar 60 by placing the bracket 12*a* with the bottom horizontal part 34*a* thereof on top of the lower support part 63 and the upper horizontal part 42*a* on top of the upper support part 64. The part 42 and upper support part 64 are secured together by a bolt passed through the aligned holes 64' and 19*a*.

One end of a tread member 10*a* is placed on top of the bottom horizontal part 34*a* of the bracket member 12*a* secured to the pillar with the hole 30*a* registering with the hole 20*a* and a bolt is passed through the hole 30*a*, the hole 20*a* and the hole in the lower support part 63 to secure these parts together. The other end of the tread member 10*a*, adjacent the wall is placed on the lower horizontal part 36*a* of the bracket 14*a* which in turn lies on the horizontal lug of the angle bracket 11 secured to the wall, the hole 26*a* registering with the hole 33*a* in the tread member and the hole 27*a* registering with the hole 32*a* in the tread member and the hole in the horizontal lug of the angle bracket 11. Bolts are passed through the aligned holes to hold the adjoining parts together.

The next riser assembly is assembled in the same way but is fitted to the lowest riser assembly in such a way that the end portion of the part 34*a* of the bracket 12*a* of said next riser assembly having the hole 20*a* is placed on top of a horizontal ledge portion 38*a* of the lowest bracket 12*a*, having the hole 22*a* and a single bolt is passed through the hole 30*a*, the registering hole 20*a* of the upper riser assembly and the registering hole 22*a* of the lower riser assembly and thus serves to secure together the upper bracket 12 and the upper tread 10 and at the same time to secure the upper riser assembly to the lower. Similarly the end portion of the lower horizontal limb of the upper bracket 14*a*, which has the hole 26*a* is placed on top of the horizontal planar part 40*a* of the lower bracket 14*a* having the hole 28*a*, with the hole 32*a* in the tread member, the hole 26*a* of the upper riser assembly and the hole 28*a* of the lower riser assembly in register and a single bolt is passed through, holding the upper tread member 10*a* and the upper bracket 14*a* together and holding the upper tread assembly on the lower assembly.

Furthermore, when the two riser assemblies are so arranged the horizontal planar part 42*a* of the upper bracket 18*a*, having the hole 19*a*, lies on top of the upper horizontal planar end part 44*a* of the lower bracket 12*a*, and the hole 19*a* of the upper bracket 12*a* is in register with the hole 18*a* of the lower bracket 12*a*. The planar part 42*a* of the upper bracket and the end part 44*a* of the lower bracket are clamped together by a single bolt passed through the aligned holes 18*a* and 19*a*.

Further riser assemblies are fitted correspondingly, each being fitted to the one below in the same fashion.

Figure 10:
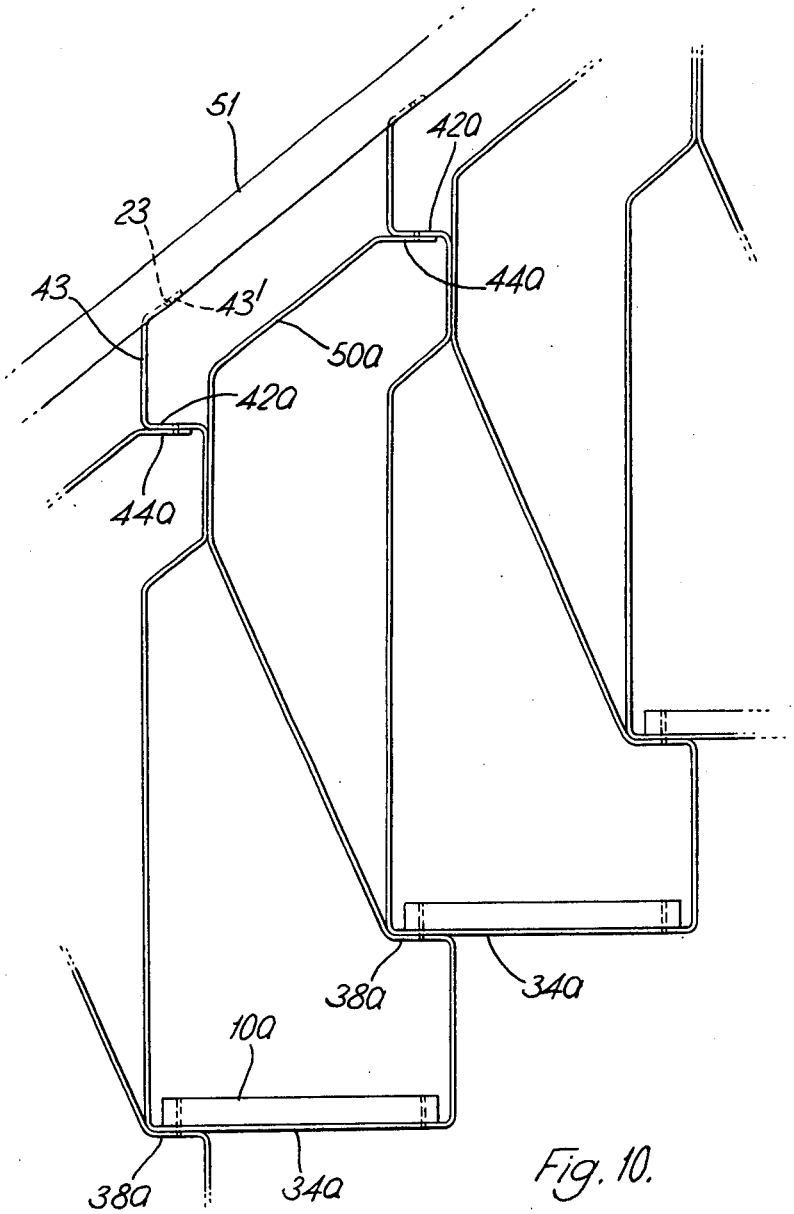
FIG. 10 is a side elevational view of one side of part of the straight staircase showing the manner in which the bracket members of FIG. 7 inter-engage.

FIG. 10 is a side elevation view from the outer side of the staircase of a number of riser assemblies so fitted, and FIG. 11 is a corresponding view of the inner side of the staircase. If desired, each bracket 14*a* may have a respective bracket 11 permanently fixed thereto, for example, by welding, rather than relying on the bolt passed through the bracket 11*a*, bracket 14*a* and associated tread member 10*a* to fix the bracket 11*a* and bracket 14*a* together.

It will be noted that each bracket 12*a* has, upstanding from the end of the horizontal limb 42*a* thereof, a vertical limb 43*a* with a sloping portion 43' at its upper end, provided with the hole 23. The slope of portion 43' is the same as the overall slope of the staircase. The sloping portions 43' are received in a shallow groove in the underside of a straight handrail 51 secured to the brackets 12*a* by screws screwed into the handrail through the holes 23. Sloping portions 50*a* of the brackets 12*a* together form a rail beneath rail 51 and parallel therewith.

Where the desired staircase height is not a multiple of the basic riser height the effective riser height of some or all riser assemblies may be increased by interposing washers 70 or spacer elements between adjacent brackets 12*a* and 14*a* of adjacent riser assemblies, around the bolts securing these brackets together as illustrated in FIG. 16.

It will be appreciated that a staircase which does not run alongside a wall may be formed using a bracket 12*a* at each end of each tread member, with two handrails 51, one at either side of the staircase.

It is possible to form a staircase having curving portions as well as straight portions, by using, over the curved sections, brackets 14*a* or 12*a*, (depending upon whether the staircase is against a wall or not) differing from those shown in having shorter horizontal dimensions, such brackets being employed on the insides of the curves and tread members of trapezoidal shape being employed. In this case, of course, corresponding portions of the handrail would also require to be suitably curved.

The curved sections of the staircase would be generally similar in form to the spiral staircase described with reference to FIGS. 1 to 6.

Referring to FIG. 14, this shows a bracket member 12*b* which is similar to the bracket member 12 of FIG. 1, parts corresponding to parts in the bracket member of FIG. 1 having the same references with the suffix *b*. The spacing and alignments of the first, second, third and fourth supporting points are the same as in FIG. 1. The bracket member 12*b* is again formed of metal strip bent and welded, but, unlike the bracket member 12 is formed from a plurality of distinct pieces of metal strip, bent and welded together in an ornamental configuration after the fashion of wrought iron work, and includes scrolls indicated at 70 and 72.

The longitudinal edges of the strip metal pieces again lie in respective ones of two parallel planes.

The additional strip metal pieces forming the ornamental work, besides imparting a pleasing appearance, not only add to the rigidity of the bracket member, but also enable a staircase assembled using such bracket members to meet certain building regulations which require that no body of more than a defined size should be able to pass between the uprights bounding a side of an open staircase.

The bracket members 12*b* may be used with identical bracket members and tread members 10 or 10*a* and bracket members such as 14 or 14*a* to construct a staircase in the same way as described with reference to FIGS. 1 to 6, the bracket members 12*b* fitting together in the same way as the bracket members 12.

FIG. 15 shows a bracket member 12*c* which is similar to the bracket member 12*a*, having in particular a part 43*c*, 43′*c* for supporting a separate handrail, as in the staircase of FIG. 10, but which, like the member 12*b*, and for the same reasons is formed by a plurality of strip metal pieces bent to appropriate forms and welded together, including scrolls 73, 74, the longitudinal edges of the strip metal pieces again lying in respective ones of two parallel planes. In FIG. 15, parts which correspond with parts in FIG. 7 are given the same reference numerals but with the suffix *c* instead of *a*. The spacing and alignments of the first, second, third and fourth supporting points are the same as in FIG. 7. The bracket member 12*c* can be used with identical bracket members 12*c*, tread members 10 or 10*a* and bracket members such as 14 or 14*a* and a separate handrail 51, to construct a staircase in the same way as described with reference to FIGS. 7 to 13. Of course, in the case of a spiral staircase using bracket members 12*b* or 12*c* or the radially outer part, bracket members having ornamental work similar to that of bracket members 12*b* or 12*c* but being of rather shorter horizontal extent and having spacings between the first and second, and between the third and fourth fixing points corresponding to such spacings in bracket member 14, may be used.

If desired, in the embodiments of FIGS. 1 to 6 or 7 to 13, panels adapted to clip onto the brackets 12 or 12*a* and/or 14 may be provided to make a closed construction.

It is contemplated that any of the staircases described might be sold as a kit so that a basic kit might comprise a number of tread members 10 or 10*a*, an equal number of brackets 12, 12*a*, 12*b* or 12*c* and an equal number of brackets 14 or 14*a*, together with the necessary fixing bolts, and possibly some spacers and washers. It is also possible, in view of the fact that the tread members may be in the form of a simple plank of suitable shape, that only the brackets 12, 14 may be sold, together with suitable bolts, the customer making the tread members himself, and the invention comprehends within its scope the brackets per se.

The riser assemblies need not be of the form shown in any of the accompanying drawings. For example, each might be formed as an integral unit, for example, moulded in glass fibre reinforced synthetic resin, providing a tread, uprights at the ends of the tread, and sloping handrail portions at the upper ends of the uprights, each upright having at its front vertical edge formations adapted to fit complementary formations at the rear vertical edge of an identical upright displaced upwardly with respect to that first mentioned, so as to provide generally horizontal abutment surfaces.

While the staircases described with reference to the drawings, have been found, particularly in spiral form, to be strong and rigid, it may be desirable, for example, in the case of a particularly long staircase, to provide the brackets 12, 12*a*, or 12*b* with formations adapted for fixing to a wall or to vertical support pillars, or to provide the brackets 14 with formations adapted for fixing to a central support pillar, so that the staircase can be supported from the ground or floor at intervals.

The term "staircase", as used herein and in the claims is intended to cover not only a complete staircase, but also a part thereof, for example, one flight of stairs in a staircase having a number of flights, or even part of a flight of stairs, the remainder of which might be of some other construction.

Although the present invention relates primarily to staircases which enables people to ascend or descend from one level to another, the term staircase as used herein is also intended to cover structures having a similar configuration but a different purpose, for example, intended as shelving or display stands. In addition, while the specification is specifically directed to the use of strip elements having planar parts, it is evident that planar positions are necessary only from the standpoint that these positions constitute flat surfaces at the points where they are joined, and hence the parts of the element, e.g., the first, second, third, fourth parts, etc., may be considered as constituting first, second, third, fourth, etc., flat surfaces respectively, oriented in directions with respect to the other elements to which they will be joined.

I claim:

1. A kit from which a staircase can be constructed, said kit comprising a plurality of identical riser units each comprising a planar slab tread member and at least two associated bracket members, each riser unit being adapted to be secured in a predetermined relation to an identical riser unit, at least one bracket member of each riser unit comprising an elongated member having a first planar part for supporting a tread, a side part extending normal to said first part from one end thereof, and a second part extending normal to the end of said side part at the end thereof away from said first part and in a direction to overlie said first part, said second part being shorter than said first part, first and second aligned holes extending through said first and second parts respectively in a direction parallel to said side part, a third hole in said first part spaced from said first hole and parallel to said side part, the axis of said third hole being spaced from said second part, said bracket having an extension from the end of at least one of said first and second parts away from said side part, whereby said extension lies on the same side of said first part as said second part, said extension having a third part parallel to said first part with a fourth hole aligned with said third hole, and a fourth part parallel to said third part with a fifth hole aligned with said second hole, said third part being spaced from said first part a greater distance than said second part, said third and fourth parts being spaced from said first and second parts by equal distances, said bracket member having adjacent said first part thereof at said third hole a first fixing point and adjacent said second part thereof at said second hole a second fixing point, adapted for fixing respectively to said second fixing point of another identical bracket member and to said first fixing point of another identical bracket member, said bracket member having adjacent said third and fourth parts thereof at said fourth and fifth holes respectively, third and fourth fixing points, said third fixing point being adapted for fixing to said fourth fixing point of an identical bracket member when the latter has the second fixing point thereof secured to said first fixing point of the bracket member in question, and said fourth point of the bracket in question being adapted for fixing to said third fixing point of an identical bracket member when the latter has the first fixing point thereof secured to said second fixing point of the bracket in question, said first, second, third and fourth fixing points of the bracket in question lying at the corners of an imaginary parallelogram, the holes of said first, second, third and fourth fixing points having axes parallel to the parallel sides of said parallelogram and extending perpendicularly through respective portions of said bracket.

2. A staircase comprising a plurality of of interconnected riser units each comprising a tread member in the form of a planar slab, and two bracket members supporting respective ends of the tread member, means connecting adjoining bracket members of adjoining riser units so that the staircase comprises a first series of interconnected bracket members and a second series of inteconnected bracket members, each said tread member extending between a respective bracket member of said first series and a respective bracket member of said second series, each bracket member including a first horizontal part and a second horizontal part at a level above that of said first horizontal part, said first horizontal part having a first hole extending vertically therethrough and said second horizontal part having a second hole extending vertically therethrough at a position spaced horizontally from the position of said first hole in the bracket member, each said bracket member having its first horizontal part overlying said second horizontal part of one of the two adjoining bracket members in the respective series and its second horizontal part lying under the first horizontal part of the other of the two adjoining bracket members in the respective series, and having its said first hole aligned vertically with said second hole of said one of the two adjoining bracket members and having its second hole aligned vertically with said first hole of said other of the two adjoining bracket members, adjacent bracket members in each said series being secured together by a respective connecting means extending through said first hole of one bracket member and said second hole of the adjacent bracket member, said tread member of each riser unit resting at each end on said first horizontal planar parrt of the respective bracket member, each said bracket member further having an upper part extending upwardly from at least one of said horizontal planar parts, said upper part including a sloping rail defining part at its upper end, and said staircase further comprising interconnecting means for interconnecting said upper parts of said adjacent bracket members, said interconnecting means being vertically aligned with said connecting means.

3. The staircase of claim 2 further comprising spacing means between the first horizontal part of one bracket member and the aligned second horizontal part of an adjacent bracket member, and aligned with the first and second holes in said last mentioned first and second horizontal parts.

4. The staircase of claim 2, wherein the horizontal spacing between said first and said second holes of each bracket in one series is different from the horizontal spacing between said first and said second fixing point of each bracket in the other series, whereby the staircase is spiral in form.

5. The staircase of claim 2, wherein each said bracket member in said first series has a third horizontal part higher than said second horizontal part and a fourth horizontal part higher than said third horizontal part and above said second horizontal part, and a sloping part extending between said third and fourth horizontal parts thereof,.

6. A staircase comprising a plurality of riser units, each said riser unit comprising a respective tread member, at least two associated bracket members, and means connecting said tread member with its associated bracket members, the staircase including means connecting each said tread member with the or each adjacent said tread member, the last mentioned means including said at least two bracket members associated with one of the two adjacent tread members so connected, each said tread member being formed separately from its associated bracket member and said means connecting each said tread member with the associated bracket members comprising fastening elements securing the tread member to the associated bracket members, said staircase including a first series of said bracket members, each associated with a respective said tread member, and means interconnecting the bracket members in said first series, and a second series of said bracket members, each associated with a respective said tread member, and means interconnecting the bracket members in said second series, and wherein each said tread member extends between a respective bracket member of said first series and a respective bracket member of said second series, and wherein the bracket members of said first series are substantially identical with each other and the bracket members of said second series are substantially identical with each other, and wherein each said bracket member has a first fixing point, and a second fixing point at a level higher than said first fixing point by the unit riser height and spaced horizontally from said first fixing point, bracket members intermediate the head and foot of the staircase each having said first fixing point of the bracket in question fixed by a respective said fastening element to said second fixing point of the next lower bracket member in the respective series and each having said second fixing point of the bracket in question fixed, by a respective said fastening element, to said first fixing point of the next upper bracket member in the respective series, the horizontal spacing between said first and said second fixing point of each bracket in one series being different from the horizontal spacing between said first and said second fixing point of each bracket in the other series, whereby the staircase is spiral in form, each tread member being a planar slab and each bracket member including a first horizontal planar part and a second horizontal planar part, the level of the upper surface of the second horizontal planar part being spaced above the level of the lower surface of the first horizontal planar part by an amount equal to the unit riser height, said first fixing point being defined by a hole extending vertically through said first horizontal planar part, and said second fixing point being defined by a hole extending vertically through said second horizontal planar part, each tread member resting on the upper surface of said first horizontal planar part of a respective bracket member of each said series, and each bracket member having the lower surface of its said first horizontal planar part engaging the upper surface of said second planar part of the next lower bracket member in the respective series, with the holes in the superimposed first and second horizontal parts in register, the tread member resting on said first horizontal part having a hole in register with the registering holes in said first and second horizontal parts and the respective said fastening element comprises a bolt passed through said registering holes and through the registering hole in the tread member resting on said first horizontal part, said bolt serving to clamp said tread member and said first and second horizontal parts together, each bracket member of said first series having a third fixing point provided by a third horizontal planar part spaced vertically above said first horizontal planar part, and a fourth fixing point provided by a fourth horizontal planar part correspondingly spaced vertically above said second horizontal planar part, said third horizontal planar part having a hole aligned vertically with that in said first horizontal planar part and said fourth horizontal planar part having a hole aligned vertically with that in said second horizontal planar part, adjacent bracket members in said first series having said fourth horizontal planar part of the lower bracket member and said third horizontal planar part of the upper bracket member superimposed and in engagement with the holes in said superimposed third and fourth horizontal planar parts in register, and a respective bolt passing through the last mentioned holes securing said superimposed parts together.

7. The staircase of claim 6, wherein each said bracket member is formed from metal strip.

8. A staircase according to claim 6 wherein said interconnecting means comprises bolt means, each tread member, at each end thereof being secured to said first horizontal planar parts on which that end rests by means of the respective bolt means passing through said first hole in the last mentioned first horizontal part, which bolt means also passes through a vertical hole in the tread member aligned vertically with the last mentioned first hole, and serves to clamp the tread member, the last mentioned first horizontal part and the underlying second horizontal part together.

9. A bracket element for a staircase comprising an elongated member having a first planar part for supporting a tread, a side part extending normal to said first part from one end thereof, and a second part extending normal to the end of said side part at the end thereof away from said first part and in a direction to overlie said first part, said second part being shorter than said first part, first and second aligned holes extending through said first and second parts respectively in a direction parallel to said side part, a third hole in said first part spaced from said first hole and parallel to said side part, the axis of said third hole being spaced from said second part, said bracket having an extension from the end of at least one of said first and second parts away from said side part, whereby said extension lies on the same side of said first part as said second part, said extension having a third part parallel to said first part with a fourth hole aligned with said third hole, and a fourth part parallel to said third part with a fifth hole aligned with said second hole, said third part being spaced from said first part a greater distance than said second part, said third and fourth parts being spaced from said first and second parts by equal distances.

10. The bracket element of claim 9 wherein said extension extends from said end of said second part.

11. The bracket element of claim 9 wherein said extension extends from said ends of said first and second parts.

12. The bracket element of claim 9 formed of strip metal, wherein said extension comprises a first strip extending from said first part to said third part, a second strip of metal extending between said third and fourth parts at an angle to said first part, and a third strip of metal extending from said second part to said first strip of metal.

13. The bracket element of claim 9 wherein said extension comprises a strip of metal extending from said second to said third part and parallel to said side part, and a second strip of metal extending from said third part to said fourth part at an angle to said first part.

14. The bracket element of claim 9 formed of strip metal wherein said extension comprises a first strip of metal extending from said first part to said third part, and a second strip of metal extending from said second part to said fourth part, said first strip of metal being joined to said second strip of metal at a point intermediate said first and third parts and said second and fourth parts respectively.

15. The bracket element of claim 14 wherein said first strip of metal extends beyond said third part and has a further hole therein aligned with said second and fourth holes for mounting a railing.

16. A bracket element for a staircase of the type formed of a plurality of similar elements, said bracket element having a first flat surface, a second flat surface parallel to and spaced from said first surface a first determined distance, a third flat surface parallel to and spaced from said first surface a second predetermined distance greater than said first distance and overlying a part of said first surface, and a fourth flat surface parallel to and overlying said second surface at a distance equal to said second predetermined distance and being spaced from said third surface a distance equal to said first predetermined distance, said second and fourth surfaces facing in the opposite directions from said first and third surfaces, said first and third surfaces having means aligned in a direction perpendicular to said surfaces for connecting said bracket element to the second and fourth surfaces of an adjacent element respectively, said second and fourth surfaces of said bracket element having means aligned in a direction perpendicular to said surfaces and spaced from the axis of said first and second connecting means for connecting said second and fourth surfaces of said bracket element respectively to the first and third surfaces respectively of a further adjacent element, said bracket element further having a surface parallel to and between said first and second surfaces for supporting a stairway tread, said further surface facing in the same direction as said second surface.

17. A staircase comprising a plurality of interconnected riser units each comprising a tread member in the form of a planar slab, and two bracket members supporting respective ends of the tread members, means connecting adjoining bracket members of adjoining riser units so that the staircase comprises a first series of interconnected bracket members and a second series of interconnected bracket members, each said tread member extending between a respective bracket member of said first series and a respective bracket member of said second series, each bracket member including a first horizontal part and a second horizontal part at a level above that of said first horizontal part, said first horizontal part having a first hole extending vertically therethrough and said second horizontal part having a second hole extending vertically therethrough at a position spaced horizontally from the position of said first hole in the bracket member, each said bracket member having its first horizontal part overlying said second horizontal part of one of the two adjoining bracket members in the respective series and its second horizontal part lying under the first horizontal part of the other of the two adjoining bracket members in the respective series, and having its said first hole aligned vertically with said second hole of said one of the two adjoining bracket members and having its second hole aligned vertically with said first hole of said other of the two adjoining bracket members, adjacent bracket members in each of said series being secured together by a respective connecting means extending through said first hole of one bracket member and said second hole of the adjacent bracket member, said tread member of each riser unit resting at each end on a said first horizontal planar part of the respective bracket member, the means connecting each bracket member with an adjoining bracket member in the respective series being located only along a single respective vertical axis, the horizontal spacing between said first and said second holes of each bracket in one series being different from the horizontal spacing between each first and said second holes of each bracket in the other series, whereby the staircase is spiral in form.

18. A staircase comprising a plurality of interconnected riser units each comprising a tread member in the form of a planar slab, and two bracket members supporting respective ends of the tread member, means connecting adjoining bracket members of adjoining riser units so that the staircase comprises a first series of interconnected bracket members and a second series of interconnected bracket members, each said tread member extending between a respective bracket member of said first series and a respective bracket member of said second series, each bracket member including a first horizontal part and a second horizontal part at a level above that of said first horizontal part, said first horizontal part having a first hole extending vertically therethrough and said second horizontal part having a second hole extending vertically therethrough at a position spaced horizontally from the position of said first hole in the bracket member, each said bracket member having its first horizontal part overlying said second horizontal part of one of the two adjoining bracket members in the respective series and its second horizontal part lying under the first horizontal part of the other of the two adjoining bracket members in the respective series, and having its said first hole aligned vertically with said second hole of said one of the two adjoining bracket members and having its second hole aligned vertically with said first hole of said other of the two adjoining bracket members, adjacent bracket members in each said series being secured together by a respective connecting means extending through said first hole of one bracket member and said second hole of the adjacent bracket member, said tread member of each riser unit resting at each end on a said first horizontal planar part of the respective bracket member, the means connecting each bracket member with an adjoining bracket member in the respective series being located only along a single respective vertical axis, each said bracket member in said first series having a third horizontal part higher than said second horizontal part and a fourth horizontal part higher than said third horizontal part and above said second horizontal part, and a sloping part extending between said third and fourth horizontal parts thereof.

19. The staircase of claim 18, including a handrail distinct from said bracket members and each bracket member in said first series includes at least one part forming a support for a handrail, and means securing each said support to said handrail.

20. A kit from which a staircase can be constructed, said kit comprising a plurality of identical riser units each comprising a planar slab tread member and at least two associated bracket members, each riser unit being adapted to be secured in a predetermined relation to an identical riser unit, at least one bracket member of each riser unit comprising an elongated member having a first planar part for supporting a tread member, a second part extending normal to said first part from one end thereof, and a second part extending normal to the end of said side part at the end thereof away from said first part and in a direction to overlie said first part, said second part being shorter than said first part, first and second aligned holes extending through said first and second parts respectively in a direction parallel to said side part, and a third hole in said first part spaced from said first hole and parallel to said side part, the axis of said third hole being spaced from said second part, said bracket having an extension from the end of at least one of said first and second parts away from said side part, whereby said extension lies on the same side of said first part as said second part, said extension having a third part parallel to said first part with a fourt hole aligned with said third hole, and a fourth part parallel to said third part with a fifth hole aligned with said second hole, said third part being spaced from said first part a greater distance than said second part, said third and fourth parts being spaced from said first and second parts by equal distances.

* * * * *

UNITED STATES PATENT OFFICE

CERTIFICATE OF CORRECTION

Patent No. 4,041,662 Dated August 16, 1977

Inventor(s) Donald Leslie Ward

It is certified that error appears in the above-identified patent and that said Letters Patent are hereby corrected as shown below:

In the Abstract, line 15: Delete this line in its entirety.

Column 1, line 7: "Staircase" should be --Staircases--.

Column 9, line 67: "parrt" should be --part--.

Column 10, line 26: "thereof,." should be --thereof.--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*